United States Patent [19]

Magendans et al.

[11] 4,320,323

[45] Mar. 16, 1982

[54] METHOD OF IMPROVING THE HEAT RADIATION PROPERTIES OF AN X-RAY TUBE ROTARY ANODE AND A ROTARY ANODE THUS OBTAINED

[75] Inventors: Frederik Magendans; Gerhardus A. Te Raa; Bernhard J. van Rheenen, all of Eindhoven, Netherlands

[73] Assignee: U.S. Philips Corporation, New York, N.Y.

[21] Appl. No.: 135,964

[22] Filed: Mar. 31, 1980

[30] Foreign Application Priority Data

May 1, 1979 [NL] Netherlands ..... 7903389

[51] Int. Cl.[3] ..... H01J 35/08; H01J 35/10

[52] U.S. Cl. ..... 313/330; 313/55; 313/60; 427/292; 427/423; 427/427; 427/328; 156/629; 156/645; 134/41; 427/123

[58] Field of Search ..... 313/55, 60, 330; 51/320, 323; 427/292, 123, 422, 427, 309, 328, 34, 423; 156/629, 645; 134/41

[56] References Cited

U.S. PATENT DOCUMENTS

| | | | |
|---|---|---|---|
| 2,376,219 | 5/1945 | Winslow | 156/645 |
| 3,037,142 | 5/1962 | Griffoul et al. | 313/60 |
| 3,400,010 | 9/1968 | Keating | 427/292 |
| 3,731,128 | 5/1973 | Haberrecker | 313/60 |
| 3,753,021 | 8/1973 | Braun | 313/60 |
| 4,038,786 | 8/1977 | Fong | 51/320 |

FOREIGN PATENT DOCUMENTS 7807119 3/1978 Fed. Rep. of Germany .

OTHER PUBLICATIONS

Hayden, Ceramic Age, Jan. 1969, pp. 40–42.

Flame Spray Handbook, Metco Inc. vol. III, Plasma Flame Process, 1965, pp. 40 and 44–45.

*Primary Examiner*—Ronald H. Smith

*Assistant Examiner*—Richard Bueker

*Attorney, Agent, or Firm*—Thomas A. Briody; David R. Treacy; Robert J. Kraus

[57] ABSTRACT

In an X-ray tube rotary anode having a supporting body (1) of molybdenum alloy, a target (2) of tungsten alloy, and a rough tungsten layer, applied by flame spraying to the whole surface of the anode except the focal path (4), for improving heat radiation, the rough tungsten layer does not adhere well to the tungsten alloy target, and particles of the rough tungsten layer may become detached in use, degrading the performance of the X-ray tube. To alleviate this problem, the whole surface of the anode, except the focal path (4), is blasted with steel grit, steel grit particles embedded in the anode are removed with acid, and the whole surface of the anode, except the target (2), is coated with a rough tungsten layer (3) by plasma spraying.

6 Claims, 1 Drawing Figure

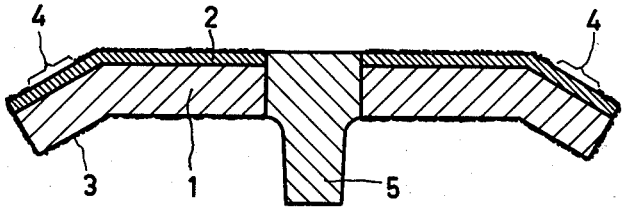
4
2
4
3
1
5

METHOD OF IMPROVING THE HEAT RADIATION PROPERTIES OF AN X-RAY TUBE ROTARY ANODE AND A ROTARY ANODE THUS OBTAINED

The invention relates to a method of improving the head radiation properties of a rotary anode for a rotary anode X-ray tube (hereinafter referred to as a "rotary anode") having a supporting body made of a molybdenum alloy and a target consisting of a tungsten alloy, wherein a heat-radiation improving layer is applied to the surface of the anode.

The invention also relates to a rotary anode thus obtained.

German utility model No. G 7807.119 discloses a rotary anode which is provided over its whole surface, the focal path excepted, with a rough tungsten layer applied by plasma spraying. The rough tungsten layer ensures improved heat radiation. The surface roughness of this known tungsen layer is between 5 and 10 micrometers. The supporting body of this known rotary anode consists of a molybdenum alloy containing titanium, zirconium and carbon and the target layer consists of a tungsten-rhenium alloy.

The prior art rotary anode has the drawback that the tungsten layer does not properly adhere to the W-Re-target layer, so that during use particles of the tungsten layer can become detached, which has an adverse effect on the operation of the X-ray tube. It is an object of the invention to provide a novel method of improving the heat radiation properties of a rotary anode in which the above-mentioned problems as regards adhesion are alleviated.

The invention is based on the recognition of the fact that no tungsten layer need be applied on the tungsten alloy target but that it is sufficient to roughen the target surface (except the focal path).

According to the invention, a method as set forth in the opening paragraph is characterized in that substantially the whole surface area, except the focal path, of the rotary anode is roughened by blasting with steel grit, in that steel grit particles embedded in the anode are removed by means of an acid, and in that substantially the whole surface of the anode, except the target, is coated with a rough tungsten layer by flame spraying.

Preferably, the steel grit has a particle size of 250 to 800 micrometers in order to obtain an optimum surface roughness and the rough tungsten layer is provided by plasma spraying and has a surface roughness of 5 to 10 micrometers. The use of steel grit having a particle size of 250 to 800 micrometers causes on the one hand the surface of the target to be roughened to such a high extent that the heat radiating properties thereof are improved and, on the other hand, the supporting body to be roughened so that proper adhesion of the tungsten layer is obtained. Acid treatment is necssary to remove the steel grit particles embedded in the anode. If these particles were not be removed, the operation of the X-ray tube, in which the rotary anode is used, would be adversely affected as the result of metal deposition onto the envelope of the X-ray tube caused by evaporation of the steel grit particles. The invention is limited to the use of steel grit as this grit can be removed by means of an acid. Other types of particles such as silicon carbide, aluminum oxide or $SiO_3$ cannot be readily removed and cause problems in maintaining the vacuum in the tube.

Plasma spraying has been found to be the most suitable manner of flame spraying tungsten.

A method embodying the invention is particularly suitable to improve the heat radiation properties of rotary anodes which are known per se and which comprise a supporting body consisting of a molybdenum-based alloy comprising titanium, zirconium and carbon, and a target consisting of a tungsten-rhenium alloy. The rotary anode may of course also comprise one or more further layers, such as a tungsten layer provided between the supporting body and the target.

From German Auslegeschrift No. 207,515 it is known per se that theoretically it must be possible to improve the heat radiation properties of X-ray rotating anodes by roughening the surface, for example by sand blasting or by the provision of the layer having improved heat radiation properties. However, this patent specification states that sand blasting of a tungsten rotating anode does not furnish useful results. During experiments relating to the present invention, it further appeared that roughening the bottom side of a rotary anode having a supporting body consisting of a molybdenum alloy does not improve the heat radiation. This is probably associated with the fact that rotary anodes are outgassed at approximately 1500°–1700° C. shortly before they are mounted in the X-ray tube. At that temperature the roughened molybdenum alloy surface becomes smooth again, whereas the roughened tungsten surface of the target remains rough.

It should further be noted that sand blasting is unsuitable; the particles of sand which become embedded in the rotary anode cannot be removed or can be removed with great difficulty. Their removal is, however, necessary to maintain a proper vacuum in the X-ray tube.

The invention will be further explained with reference to the accompanying diagrammatic drawing wherein:

The sole FIGURE is a cross-sectional view of a rotary anode embodying the invention.

The FIGURE shows a rotary anode whose heat radiation properties have been improved by a method embodying the invention. Reference numeral 1 denotes the supporting body consisting of a molybdenum alloy. Suitable molybdenum alloys are for example, those alloys containing either titanium, zirconium and carbon or tungsten as the alloying element. Reference numeral 2 denotes a target consisting of a tungsten alloy covering one side of the supporting body 1. Suitable tungsten alloys are, for example, those alloys containing rhenium or rhenium and other elements. Reference numeral 3 denotes the rough tungsten layer which has been provided by flame spraying, for example by plasma spraying or flame arc spraying. The focal path is indicated by reference numeral 4 and the bush is denoted by 5. The surface of the target 2, except the focal path 4, is rough as a result of steel grit blasting. The target may cover a smaller portion of the anode surface than shown in the FIGURE, but it must of course include the focal path 4.

A method embodying the invention is performed as follows. A rotary anode having a supporting body consisting of a molybdenum alloy (for example containing 0.4–0.5% by weight of Ti, 0.06–0.12% by weight of Zr and 0.01–0.04% by weight of C), and a target consisting of a tungsten alloy (for example containing 3.0–5.5% by weight of rhenium), is roughened over its whole surface, the focal path excepted, by blasting with steel grit having a particle size of 250 to 800 micrometers. During blasting, the focal path is protected by means of a mask.

Satisfactory results have been obtained with steel grit of the type No. GH 50 marketed by WHEEL ABRATOR. The steel grit particles embedded in the anode are removed by dissolving them in an approximately 18% hydrochloric solution (percentage by weight in water). A tungsten layer (preferably 20 to 200 micrometers thick) is thereafter provided on the other side of the supporting body by plasma spraying. Shortly before mounting in the X-ray tube, the rotary anode is outgassed (for example at 1600° C. for ½–2 hours).

No problems have been experienced as regards adhesion of the flame-sprayed tungsten layer with the rotary anode thus obtained (as no tungsten layer is applied to the target), the anode having heat radiating properties which are equivalent to those of a rotary anode produced in accordance with the above-mentioned German utility model No. G 78.07.119.

What is claimed is:

1. A method for improving the heat radiation properties of a rotary anode having a supporting body consisting of a molybdenum alloy and a target consisting of a tungsten alloy, a portion only of said target being adapted for use as a focal path, wherein a heat radiation improving layer is applied to the surface of the anode, characterized by roughening substantially the whole surface, except the focal path, of the rotary anode by blasting with steel grit, then removing any steel grit particles embedded in the anode by means of an acid, and then coating substantially the whole surface of the anode, except the target, with a rough tungsten layer by flame spraying.

2. A method as claimed in claim 1 wherein the target covers substantially all of one side of the supporting body, and the coating step consists of spraying a rough tungsten layer on the other side.

3. A method as claimed in claim 1, characterized in that the supporting body consists of a molybdenum-based alloy comprising titanium, zirconium and carbon and the target consists of a tungsten-rhenium alloy.

4. A method as claimed in claim 3, characterized in that the steel grit has a particle size of 250–800 micrometers and the rough tungsten layer is provided by plasma spraying and has a surface roughness of 5 to 10 micrometers.

5. A method as claimed in claim 4, characterized in that the supporting body consists of a molybdenum-based alloy comprising titanium, zirconium and carbon and the target consists of a tungsten-rhenium alloy.

6. A rotary anode obtained by means of a method as claimed in any of claims 1, 2, 3, 4 or 5.

* * * * *

UNITED STATES PATENT AND TRADEMARK OFFICE

CERTIFICATE OF CORRECTION

PATENT NO. : 4,320,323

DATED March 16, 1982

INVENTOR(S) : FREDERIK MAGENDANS ET AL

It is certified that error appears in the above—identified patent and that said Letters Patent is hereby corrected as shown below:

Column 4, line 17, change "3" to --1--

Signed and Sealed this

*Fifteenth* Day of *June 1982*

[SEAL]

*Attest:*

GERALD J. MOSSINGHOFF

*Attesting Officer*

*Commissioner of Patents and Trademarks*